US010697113B2

(12) United States Patent
Spill et al.

(10) Patent No.: US 10,697,113 B2
(45) Date of Patent: Jun. 30, 2020

(54) MAKING FABRICS EASIER TO IRON

(71) Applicant: Henkel AG & Co. KGaA, Duesseldorf (DE)

(72) Inventors: Iwona Spill, Berlin (DE); Peter Schmiedel, Duesseldorf (DE); Markus Oberthuer, Krefeld (DE); Vahid Ameri Dehabadi, Cologne (DE); Hans-Juergen Buschmann, Kempen (DE); Jochen Stefan Gutmann, Krefeld (DE)

(73) Assignee: Henkel AG & Co. KGaA (DE)

( * ) Notice: Subject to any disclaimer, the term of this patent is extended or adjusted under 35 U.S.C. 154(b) by 43 days.

(21) Appl. No.: 15/589,232

(22) Filed: May 8, 2017

(65) Prior Publication Data

US 2017/0241073 A1 Aug. 24, 2017

Related U.S. Application Data

(63) Continuation of application No. PCT/EP2015/075075, filed on Oct. 29, 2015.

(30) Foreign Application Priority Data

Nov. 11, 2014 (DE) ..... 10 2014 222 924

(51) Int. Cl.

| | |
|---|---|
| ***D06M 15/643*** | (2006.01) |
| ***D06M 15/61*** | (2006.01) |
| ***C11D 3/37*** | (2006.01) |
| ***C11D 11/00*** | (2006.01) |
| ***D06M 23/06*** | (2006.01) |
| ***D06M 15/356*** | (2006.01) |
| ***D06M 23/10*** | (2006.01) |
| *D06M 101/06* | (2006.01) |

(52) U.S. Cl.

CPC ..... *D06M 15/6436* (2013.01); *C11D 3/3723* (2013.01); *C11D 3/3742* (2013.01); *C11D 3/3769* (2013.01); *C11D 11/0017* (2013.01); *D06M 15/3562* (2013.01); *D06M 15/61* (2013.01); *D06M 23/06* (2013.01); *D06M 23/10* (2013.01); *D06M 2101/06* (2013.01); *D06M 2200/20* (2013.01); *D10B 2201/02* (2013.01)

(58) Field of Classification Search

CPC ..... D06M 15/6436
USPC ..... 427/355
See application file for complete search history.

(56) References Cited

U.S. PATENT DOCUMENTS

| | | | | |
|---|---|---|---|---|
| 4,359,545 | A * | 11/1982 | Ona | C08L 83/12 252/8.61 |
| 6,277,445 | B1 | 8/2001 | Hasegawa et al. | |
| 6,379,751 | B1 | 4/2002 | Schaefer et al. | |
| 2004/0043915 | A1 | 3/2004 | Whilton | |
| 2004/0139559 | A1* | 7/2004 | Detering | C11D 3/3723 8/181 |
| 2011/0190190 | A1* | 8/2011 | Schubert | C08G 77/388 510/329 |

FOREIGN PATENT DOCUMENTS

| | | |
|---|---|---|
| CN | 1793483 A | 6/2006 |
| EP | 0095676 | 5/1983 |
| GB | 1473202 | 4/1974 |

OTHER PUBLICATIONS

PCT International Search Report (PCT/EP2015/075075) dated Feb. 1, 2016.

DIN53890, Deutsche Normen, Henkel, Jan. 1972.

Tetracarboxylic Acids as Formaldehyde-Free Durable Press Finishing Agents, Textile Research Journal 1988, 480-486.

Wrinkle Recovery for Cellulosic Fabric by Means of Ionic Crosslinking, Textile Research Journal 2003, 762-766.

* cited by examiner

*Primary Examiner* — Tabatha L Penny
(74) *Attorney, Agent, or Firm* — Bojuan Deng

(57) ABSTRACT

The aim is to reduce the wrinkling tendency of a cotton textile or otherwise cellulosic textile. This was achieved by bringing the textile into contact with an amino-group-containing polymer having carboxylic-acid-group-bearing substituents and optionally subsequently ironing the textile.

8 Claims, No Drawings

MAKING FABRICS EASIER TO IRON

FIELD OF THE INVENTION

The present invention generally relates to the use of amino-group-containing polymers having carboxylic-acid-group-bearing substituents to reduce the wrinkling tendency of textiles made of cellulose-containing material and to make said textiles easier to iron, and a method, which can be performed in the home, for treating textiles made of cellulose-containing material in such a way that ironing is made easier and/or the wrinkling tendency is reduced.

BACKGROUND OF THE INVENTION

From the consumer's point of view, textiles made of cellulose, such as cotton or regenerated cellulose fibers (for example, modal or lyocell), have positive characteristics in respect of wear comfort. However, a big disadvantage of these textiles is that these textiles easily wrinkle while worn, after washing and drying. This wrinkling tendency is based on the swelling of the cellulose fibers and the low elastic restoring forces ("resilience") of the cellulose fibers after deformation.

Therefore, it has long been common that, after washing and drying, cotton textiles or cellulosic textiles are ironed and thereby brought into the desired shape. However, it would be advantageous for the consumer if the consumer could reduce the formation wrinkles as part of the textile care, which would make the work of ironing easier or, ideally, make ironing completely unnecessary.

In the production of textiles, an attempt is made to avoid the wrinkling tendency of the cellulose molecules by means of permanent textile finishing processes by cross-linking the cellulose molecules. The cross-linking of the cellulose molecules increases the elasticity of the material. The wrinkling-avoiding finishing processes are performed on the gray goods as part of the textile finishing. However, cross-linking agents that are used in the textile industry, such as formaldehyde-urea and formaldehyde-melamine combinations, are not suitable for use in washing agents or for use in the home because of the toxicity of said cross-linking agents or because of the conditions under which said cross-linking agents must be used.

Formaldehyde-free cross-linking methods for cellulose are also known, such as a cross-linking method known from U.S. 20040043915 A1, which is performed by means of hydroxy-group-bearing polymer and polycarboxylic acids, particularly butanetetracarboxylic acid (BTCA). The use of tetracarboxylic acids to cross-link cellulose fibers is known from the article by C. M. Welch in Textile Research Journal, 1988, 480-486. In principle, these formaldehyde-free approaches to cellulose cross-linking by means of polycarboxylic acids could be suitable for use in the home from a toxicological perspective. Unfortunately, the reactions of the carboxyl groups of polycarboxylic acids with the hydroxyl groups of the cellulose, which lead to esters, require a large amount of catalysts such as triazoles or hypophosphites or phosphites and high temperatures. This is not practical for an end-consumer product.

In another approach, as described for example by M. Hashem, P. Hauser, and B. Smith in Textile Research Journal, 2003, 762-766, ion pair bonds are used to cross-link the cellulose. Cotton typically has a content of carboxyl groups of approximately $10^{-6}$ mol/g. To achieve the most ion pair contacts possible, the cellulose can be treated with chloroacetic or bromoacetic acid to increase the number of carboxyl groups of the cellulose. Because of the interaction of the carboxylated cellulose with polycations such as cationized chitosan, ionic cross-linking can arise, which reduces the wrinkling tendency. The effect is too small without the carboxylation, and the carboxylation of cotton textiles with haloacetic acids is out of the question for home use.

From the patent application CN 1793483 A, a method for producing modified cotton fibers is known, which comprises the steps of oxidizing bleached cotton fibers with periodate, removing the oxidant, washing and drying the cellulose fibers, and cross-linking by reaction with a substance containing OH and $NH_2$ groups, such as collagen, chitosan, silk fibroin, or sericin.

Accordingly, it is desirable to have an improved agent suitable for treating cotton or cellulosic textiles at home in order to reduce the wrinkling tendency of the textiles and also make the textiles easier to iron. In addition, it is desirable to have an improved method, adapted to be performed at home, for treating textiles made of cellulose-containing material in such a way that ironing is made easier and/or the wrinkling tendency is reduced. Furthermore, other desirable features and characteristics of the present invention will become apparent from the subsequent detailed description of the invention and the appended claims, taken in conjunction with this background of the invention.

BRIEF SUMMARY OF THE INVENTION

Therefore, the invention relates to the use of an amino-group-containing polymer having carboxylic-acid-group-bearing substituents to reduce the wrinkling tendency of textiles made of cellulose-containing material. The invention also relates to the use of an amino-group-containing polymer having carboxylic-acid-group-bearing substituents to make the ironing of textiles made of cellulose-containing material easier.

The invention also relates to methods, which can be performed in the home, for treating textiles made of cellulose-containing material in such a way that ironing is made easier and/or the wrinkling tendency is reduced, by bringing the textile into contact with an amino-group-containing polymer having carboxylic-acid-group-bearing substituents.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

It has surprisingly been found that the wrinkling tendency of a cotton textile or otherwise cellulosic textile (made of regenerated cellulose fibers, for example) can be reduced by bringing said textile into contact with an amino-group-containing polymer that has carboxylic-acid-group-bearing substituents and then optionally ironing said textile.

The cellulose-containing materials from which the textiles to be treated are produced included cotton, regenerated cellulose fibers such as model or lyocell, and blended woven fabrics of cotton or regenerated cellulose fibers with other materials typical for clothing purposes, such as polyester and polyamide.

In preferred embodiments of the invention, the textile is ironed with a common household iron after the treatment with said polymer.

The measures of the invention considerably reduce the wrinkling tendency of textiles made of cellulose-containing material in comparison with the untreated starting textiles or exclusive treatment with an amino-group-containing polymer that is not carboxylic-acid-substituted. With no intention of being bound to this theory, it is conceivable that the reaction of carboxyl groups of the polymer with hydroxyl groups of the cotton leads to covalent bonds (ester bonds). In addition, the amino groups of the polymer can possibly electrostatically interact with carboxyl groups of the cotton (ionic cross-linking). The both covalent and ionic cross-linking could lead to increased resilience of the textile and therefore to a reduction in wrinkling.

The wrinkle-free effect can be evaluated by measuring the crease recovery angle in accordance with DIN 53890:1972. Unfinished cotton generally has a crease recovery angle of approximately 60° to 80°. Use of the present invention results in crease recovery angle values considerably above 80°.

The polymer used in the context of the invention does not have any further nucleophilic units such as hydroxyl groups in addition to the several amino groups and the carboxyl groups. Polymers preferred according to the invention are selected from aminopolysiloxanes, polyvinylamines, and polyalkylene imines, such as polyethylene imines, and mixtures thereof, which, on the nitrogen atom of the amino function, bear substituents having carboxyl groups. Preferably, not every nitrogen atom of the amino-group-containing polymer is provided with a carboxyl-group-bearing substituent, but rather only a fraction of the number of nitrogen atoms of the amino-group-containing polymer has a carboxyl-group-bearing substituent. The polymers that can be used according to the invention can be obtained by reacting aminopolysiloxanes, polyvinylamines, or polyalkylene imines with haloalkanoic acids, such as bromoacetic acid. Preferably, only such molar amounts of haloalkanoic acid with respect to amino-group-containing polymer are used that carboxylic-group-bearing substituents are not introduced at all nitrogen atoms of the amino groups of the polymer.

Polyvinylamines are produced by means of polymer-analogous reactions, for example by the hydrolysis of poly (N-vinylamides), such as poly(N-vinylformamide) or poly (N-vinylacetamide), or poly(N-vinylimides), such as poly (N-vinylsuccinimide), which can be easily obtained by polymerizing the corresponding monomers, or are produced from polyacrylamide by Hofmann decomposition.

Polyalkylene imines are polymers having an N-atom-containing backbone that is linked by alkylene groups and that can bear alkyl groups at the non-N atoms. The polyalkylene imine has preferably primary amino functions at the ends and preferably both secondary and tertiary amino functions in the interior. The polyalkylene imine can also have only secondary amino functions in the interior, so that not a branched-chain polymer but rather a linear polymer results. The ratio of primary to secondary amino groups in the polyalkylene imine lies preferably in the range of 1:0.5 to 1:1.5, particularly in the range of 1:0.7 to 1:1. The ratio of primary to tertiary amino groups in the polyalkylene imine lies preferably in the range of 1:0.2 to 1:1, particularly in the range of 1:0.5 to 1:0.8. The polyalkylene imine preferably has an average molar mass in the range of 500 g/mol to 50000 g/mol, particularly 550 g/mol to 5000 g/mol. The average molar masses specified here and possibly for other polymeric ingredients are weight-average molar masses $M_w$, which generally can be determined by gel permeation chromatography by means of an RI detector, wherein the measurement is advantageously performed against an external standard. The N atoms in the polyalkylene imine are preferably separated from each other by alkylene groups having 2 to 12 C atoms, particularly 2 to 6 C atoms, wherein not all alkylene groups must have the same number of C atoms. Especially preferred are ethylene groups, 1,2-propylene groups, 1,3-propylene groups, and mixtures thereof. Some of the amino functions in the polyalkylene imine can optionally bear 1 or 2 alkyl groups, wherein the alkyl groups are preferably propyl and/or ethyl groups.

Aminopolysiloxanes preferred in the context of the present invention have the general formula (I),

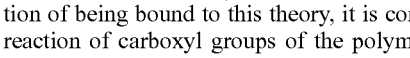

$$R^1{}_2R^2Si—O—(SiR^1R^2—O—)_nSiR^1{}_2R^2,$$

in which $R^1$ represents straight-chain or branched or cyclic $C_1$ to $C_{18}$ hydrocarbon residues, $R^2$ represents $R^1$ or one of the groups $—R^3—NHR^4$ or $—R^3—NR^4—R^3—NHR^4$, in which $R^3$ represents a straight-chain or branched or cyclic divalent $C_1$ to $C_{18}$ hydrocarbon residue and $R^4$ represents a hydrogen atom, a $C_1$ to $C_{10}$ alkyl residue, and n represents a value from 10 to 2000, wherein not all residues not all residues $R^2$, not all residues $R^3$, and not all residues $R^4$ must be identical in the compound, with the stipulation that at least 2 of the residues $R^2$ are not $R^1$ and, in at least 1, preferably in at least 2 of the residues $R^2$ that are not the residue $R^4$ is a group $—R^5—COOX$, in which $R^5$ is a divalent hydrocarbon residue having 1 to 30 carbon atoms, particularly 2 to 20 carbon atoms, and X is hydrogen, an alkali metal, or an ammonium group.

Examples of $C_1$-$C_{18}$ hydrocarbon residues $R^1$ are methyl, ethyl, n-propyl, isopropyl, n-butyl, isobutyl, tert-butyl, n-pentyl, neopentyl, tert-pentyl, n-hexyl, n-heptyl, n-octyl, trimethylpentyl, n-nonyl, n-decyl, n-undecyl, n-dodecyl, cycloalkyl, particularly cyclopentyl or cyclohexyl, methylcyclohexyl, aryl, particularly phenyl or naphthyl, alkaryl, particularly o-, m-, or p-toluyl, xylyl, or ethylphenyl; aralkyl residues, particularly benzyl or α- or β-phenylethyl. The hydrocarbon residues can optionally contain a C=C double bond. Examples are alkenyl residues such as vinyl, allyl, 5-hexenyl, E-4-hexenyl, Z-4-hexen-1-yl, 2-(3-cyclohexenyl)-ethyl-, and cyclododeca-4,8-dienyl. Preferred residues having an aliphatic double bond are vinyl, allyl, and the 5-hexenyl residue. However, preferably at most 1% of the hydrocarbon residues $R^1$ contain a C=C double bond. Examples of $C_1$ to $C_{10}$ alkyl residues $R^4$ are the examples of linear and cyclic alkyl residues having at most 10 C atoms that are listed above for $R^1$. Examples of the divalent $C_1$ to $C_{18}$ hydrocarbon residues $R^3$ are saturated straight-chain or branched-chain or cyclic alkylene residues such as the methylene and ethylene residues and propylene, butylene, pentylene, hexylene, 2-methylpropylene, cyclohexylene, and octadecylene residues or unsaturated alkylene or arylene residues such as the hexenylene residue and phenylene residue, wherein the n-propylene residue and the 2-methylpropylene residue are especially preferred. Preferred examples of the divalent hydrocarbon residues $R^5$ are the examples listed above for $R^1$, wherein the ethylene group is especially preferred.

The textile made of cellulose-containing material is preferably brought into contact with said amino-group-containing polymer having carboxylic-acid-group-bearing substituents at temperatures in the range of 10° C. to 100° C., particularly 20° C. to 60° C. Furthermore, the textile made of cellulose-containing material is preferably brought into contact with the amino-group-containing polymer having carboxylic-acid-group-bearing substituents over a time span of 10 minutes to 180 minutes, particularly 30 minutes to 60 minutes. With no intention of being bound to this theory, it is suspected that the fulfillment of at least one of these conditions leads to a chemical reaction of the cellulose with the amino-group-containing polymer having carboxylic-acid-group-bearing substituents to such an extent that an especially large reduction in the wrinkling tendency is observed.

The invention can be performed, for example, in such a way that textiles made of cellulose-containing material are brought into contact with an aqueous preparation that contains said polymer. Said aqueous preparation can be used in a common washing method, which can be performed by means of a household washing machine or by hand. The amino-group-containing polymer is used preferably in the rinsing step, i.e., after the actual washing step. However, it is also possible to use the amino-group-containing polymer and washing agent together in the washing step. The polymer essential to the invention can be a constituent of agents used in such washing methods, or said polymer can be separately added to such agents or aqueous preparations containing such agents.

Therefore, the present invention also relates to a washing agent or laundry care agent containing an amino-group-containing polymer having carboxylic-acid-group-bearing substituents.

In this case, it is possible to use said polymer as such; however, the active substance can also be in a product form that makes the use by the user easier, for example in a mixture or granulated with carrier substances, binders, wrapping materials, extrusion aids, pourability improvers, stabilizers, solvents, rheology modifiers, and/or emulsifiers. This embodiment of the invention makes it possible for the consumer, in an easy manner, to allow the advantages of the invention to take effect only when they are desired, by using said polymer in addition to conventional washing and/or laundry aftertreatment agents.

Said polymer can be present in a liquid or solid agent, wherein single dosing (bag packaging, pouch) of the agent is also possible.

Said polymer can also be contained in a liquid spray product, which can be sprayed onto a textile after dilution with water or, in particular, in undiluted form. In a preferred embodiment of the invention, said polymer is applied to the textile after the washing and drying of the textile, particularly by spraying said polymer on in the form of a liquid spray product.

After the use of said polymer, it is preferred that the textile is ironed once or a few times under conditions typical in the home. Particularly as a result thereof, an especially high effect is achieved, which increases the elasticity and resilience of the textile in an exceptional manner and fixes the textile in this desired form in an exceptional manner. In washing cycles which follow the ironing, with use of said polymer, wrinkling is reduced to an exceptional extent. In addition, the formation of wrinkles as the textiles are worn is reduced.

Therefore, the present invention also relates to a method in which a textile composed of or containing a cotton material or other cellulosic material is brought into contact with an amino-group-containing polymer having carboxylic-acid-group-bearing substituents and then is fixed in the desired form by means of an iron that is typical in the home. Ironing temperatures in the range of 50° C. to 220° C., particularly 100° C. to 160° C., preferably occur.

A cumulative effect of the system according to the invention arises in the case of a few, for example 1 to 5, repeated uses. The textile does not have to be ironed after each use. The crease recovery angle improves from use to use. This cumulative effect makes it possible to use lower concentrations of the active substance according to the invention. Furthermore, it reduces the risk of damaging a textile by ironing in an undesired form (for example, a crease); errors in the ironing can be corrected in the next use. For this reason, a dosage of the active substances essential to the invention that causes a cumulative effect is preferred. The concentration of amino-group-containing polymer having carboxylic-acid-group-bearing substituents in an aqueous treatment bath lies, in particular, in the range of 0.1 g/l to 10 g/l, especially preferably 0.2 g/l to 2 g/l.

Washing or laundry care agents that contain the active substance to be used according to the invention or that are used together with said active substance or that are used in the method according to the invention can contain all common other constituents of such agents that do not interact with the active substance essential to the invention in an undesired manner.

Such an agent preferably contains synthetic anionic surfactants of the sulfate or sulfonate type, in amounts of preferably not more than 20 wt %, particularly 0.1 wt % to 18 wt %, with respect to the entire agent. The alkyl and/or alkenyl sulfates having 8 to 22 C atoms and bearing an alkali-, ammonium-, or alkyl- or hydroxyalkyl-substituted ammonium ion as a counter-cation should be mentioned as synthetic anionic surfactants especially suitable for use in such agents. The derivatives of the fatty alcohols having, in particular, 12 to 18 C atoms and the branched-chain analogs thereof, the so-called oxo alcohols, are preferred. The alkyl and alkenyl sulfates can be produced in a known manner by reacting the corresponding alcohol component with a common sulfation reagent, particularly sulfur trioxide or chlorosulfonic acid, and by subsequent neutralization with alkali-, ammonium-, or alkyl- or hydroxyalkyl-substituted ammonium bases. The surfactants of the sulfate type that can be used with particular preference include the aforementioned sulfated alkoxylation products of said alcohols, so-called ether sulfates. Such ether sulfates preferably contain 2 to 30, particularly 4 to 10, ethylene glycol groups per molecule. The suitable anionic surfactants of the sulfonate type include the α-sulfoesters that can be obtained by reacting fatty acid esters with sulfur trioxide and by subsequent neutralization, particularly the sulfonation products derived from fatty acids having 8 to 22 C atoms, preferably 12 to 18 C atoms, and from linear alcohols having 1 to 6 C atoms, preferably 1 to 4 C atoms, and the sulfo fatty acids resulting therefrom by formal saponifcation. The anionic surfactants that can be used also include the salts of sulfosuccinic acid esters, which are also referred to as alkyl sulfosuccinates or dialkyl sulfosuccinates and which are monoesters or diesters of sulfosuccinic acid with alcohols, preferably fatty alcohols and particularly ethoxylated fatty alcohols. Preferred sulfosuccinates contain $C_8$ to $C_{18}$ fatty alcohol residues or mixtures thereof. Particularly preferred sulfosuccinates contain an ethoxylated fatty alcohol residue, which, considered separately, is a nonionic surfactant. In turn, sulfosuccinates whose fatty alcohol residues are derived from ethoxylated fatty alcohols having a restricted homolog distribution are especially preferred. Alkylbenzene sulfonate is possible as a further synthetic anionic surfactant.

A further embodiment of the agents comprises the presence of nonionic surfactant, selected from fatty alkyl polyglycosides, fatty alkyl polyalkoxylates, particularly fatty alkyl polyethoxylates and/or polypropoxyltates, fatty acid polyhydroxyamides and/or ethoxylation and/or propoxylation products of fatty alkyl amines, vicinal diols, fatty acid alkyl esters, and/or fatty acid amides and mixtures thereof, particularly in amount in the range of 2 wt % to 25 wt %.

The possible nonionic surfactants include the alkoxylates, particularly the ethoxylates and/or propoxylates of saturated or mono- to polyunsaturated linear or branched-chain alcohols having 10 to 22 C atoms, preferably 12 to 18 C atoms. The degree of alkoxylation of the alcohols is generally between 1 and 20, preferably between 3 and 10. Said alkoxylates can be produced in a known manner by reacting the corresponding alcohols with the corresponding alkylene oxides. In particular, the derivatives of the fatty alcohols are suitable, although the branched-chain isomers thereof, particularly so-called oxo alcohols, can also be used to produce usable alkoxylates. Accordingly, the alkoxylates, particularly the ethoxylates, of primary alcohols with linear, particularly dodecyl, tetradecyl, hexadecyl, or octadecyl residues and mixtures thereof are usable. In addition, corresponding alkoxylation products of alkyl amines, of vicinal diols, and of carboxylic acid amides that correspond to said alcohols with regard to the alkyl part can be used. Also considered are the ethylene oxide and/or propylene oxide insertion products of fatty acid alkyl esters, and fatty acid polyhydroxamides. So-called alkyl polyglycosides suitable for incorporation into the agents according to the invention are compounds of the general formula $(G)_n$-$OR^{12}$, in which $R^{12}$ means an alkyl or alkenyl residue having 8 to 22 C atoms, G means a glucose unit, and n means a number between 1 and 10. The glycoside component $(G)_n$ is an oligomer or polymer of naturally occurring aldose or ketose monomers, which include, in particular, glucose, mannose, fructose, galactose, talose, gulose, altrose, allose, idose, ribose, arabinose, xylose, and lyxose. The oligomers consisting of such glycosidically linked monomers are characterized not only by the type of sugars contained therein but also by the number thereof, the so-called degree of oligomerization. The degree of oligomerization n, as a quantity to be determined analytically, generally assumes rational numerical values. The degree of oligomerization has values between 1 and 10; for the preferably used glycosides, the degree of oligomerization is below a value of 1.5, particularly between 1.2 and 1.4. A preferred monomer unit is glucose, because of good availability. The alkyl or alkenyl part $R^{12}$ of the glycosides preferably likewise originates from easily obtainable derivatives of renewable raw materials, particularly from fatty alcohols, although branched-chain isomers thereof, particularly so-called oxo alcohols, also can be used to produce usable glycosides. Accordingly, in particular the primary alcohols having linear octyl, decyl, dodecyl, tetradecyl, hexadecyl, or octadecyl residues and mixtures thereof are usable. Especially preferred alkyl glycosides contain a coconut fatty alkyl residue, i.e., mixtures having largely $R^{12}$=dodecyl and $R^{12}$=tetradecyl.

In agents that contain an active substance used according to the invention or that are used in the context of the use according to the invention or in the context of the method according to the invention, nonionic surfactant is contained preferably in amounts of 1 wt % to 30 wt %, particularly 1 wt % to 25 wt %, wherein amounts in the upper part of this range are found more likely in liquid agents and particulate agents preferably contain smaller amounts of up to 5 wt %.

Soaps are considered as further optional surfactant ingredients, wherein saturated fatty acid soaps, such as the salts of lauric acid, myristic acid, palmitic acid, or stearic acid, and soaps derived from natural fatty acid mixtures, such as coconut, palm kernel, or tallow fatty acids, are suitable. In particular, soap mixtures that are composed of 50 wt % to 100 wt % of saturated $C_{12}$-$C_{18}$ fatty acid soaps and up to 50 wt % of oleic acid soap are preferred. Soap is preferably contained in amounts of 0.1 wt % to 5 wt %. However, particularly in liquid agents that contain an active substance used according to the invention, higher soap amounts of, in general, up to 20 wt % can also be contained.

The agents can optionally also contain betains and/or cationic surfactants, which—if present—are preferably used in amounts of 0.5 wt % to 7 wt %. Among these, esterquats are especially preferred.

The agents can optionally contain peroxygen-based bleaching agents, particularly in amounts in the range of 5 wt % to 70 wt %, and possibly bleach activators, particularly in amounts in the range of 2 wt % to 10 wt %. The considered bleaching agents are preferably the peroxygen compounds generally used in washing agents, such as percarboxylic acids, for example dodecanedioic peracid or phthaloylaminoperoxicaproic acid, hydrogen peroxide, alkali perborate, which can be in the form of a tetra- or monohydrate, percarbonate, perpyrophosphate, and persilicate, which are generally in the form of alkali salts, particularly sodium salts. In washing agents that contain an active substance used according to the invention, such bleaching agents are present preferably in amounts of up to 25 wt %, particularly up to 15 wt %, and especially preferably 5 wt % to 15 wt %, with respect to the entire agent, wherein in particular percarbonate is used. The optionally present component of the bleach activators comprises the typically used N- or O-acyl compounds, such as polyacylated alkylene diamines, particularly tetraacetylethylenediamine, acylated glycolurils, particularly tetraacetylglycoluril, N-acylated hydantoins, hydrazides, triazoles, urazoles, diketopiperazines, sulfuryl amides, and cyanurates, additionally, carboxylic acid anhydrides, particularly phthalic anhydride, carboxylic acid esters, particularly sodium isononanoyl phenol sulfonate, and acylated sugar derivatives, particularly pentaacetylglucose, and cationic nitrile derivatives such as trimethylammonium acetonitrile salts. The bleach activators can have been coated with coating substances and/or granulated in a known manner to avoid interaction with the peroxygen compounds during storage, wherein tetraacetylethylenediamine granulated by means of carboxymethyl cellulose and having average grain sizes of 0.01 mm to 0.8 mm, granulated 1,5-diacetyl-2,4-dioxohexahydro-1,3,5-triazine, and/or trialkylammonium acetonitrile produced in particle form is especially preferred. Such bleach activators are contained in washing agents preferably in amounts of up to 8 wt %, particularly 2 wt % to 6 wt %, with respect to the entire agent.

In a further embodiment, the agent contains water-soluble and/or water-insoluble builder, particularly selected from alkali aluminosilicate, crystalline alkali silicate having a modulus above 1, monomeric polycarboxylate, polymeric polycarboxylate, and mixtures thereof, particularly in amounts in the range of 2.5 wt % to 60 wt %.

The agent contains preferably 20 wt % to 55 wt % of water-soluble and/or water-insoluble, organic and/or inorganic builder. The water-soluble organic builder substances include, in particular, those from the class of the polycarboxylic acids, particularly citric acid and sugar acids, and of the polymeric (poly)carboxylic acids, particularly the polycarboxylates obtainable by oxidizing polysaccharides, and polymeric acrylic acids, methacrylic acids, maleic acids, and copolymers thereof, which can also contain small fractions of polymerizable substances without carboxylic acid functionality polymerized therein. The relative molecular mass of the homopolymers of unsaturated carboxylic acids lies generally between 5000 g/mol and 200000 g/mol, that of the copolymers between 2000 g/mol and 200000 g/mol, preferably 50000 g/mol to 120000 g/mol, with respect to free acid. An especially preferred acrylic acid-maleic acid copolymer has a relative molecular mass of 50000 g/mol to 100000 g/mol. Suitable though less preferred compounds of this class are copolymers of acrylic acid or methacrylic acid with vinyl ethers, such as vinyl methyl ethers, vinyl ester, ethylene, propylene, and styrene, in which the percentage of the acid is at least 50 wt %. Terpolymers containing two carboxylic acids and/or salts thereof as monomers and vinyl alcohol and/or a vinyl alcohol derivative or a carbohydrate as a third monomer can also be used as water-soluble organic builder substances. The first acidic monomer or salt thereof is derived from a monoethylenically unsaturated $C_3$-$C_8$ carboxylic acid and preferably from a $C_3$-$C_4$ monocarboxylic acid, particularly from (meth)acrylic acid. The second acidic monomer or salt thereof can be a derivative of a $C_4$-$C_8$ dicarboxylic acid, wherein maleic acid is especially preferred. In this case, the third monomeric unit is formed by vinyl alcohol and/or preferably an esterified vinyl alcohol. Particularly preferred are vinyl alcohol derivatives that are an ester of short-chain carboxylic acids, such as $C_1$-$C_4$ carboxylic acids, with vinyl alcohol. Preferred terpolymers contain 60 wt % to 95 wt %, particularly 70 wt % to 90 wt %, of (meth)acrylic acid and/or (meth)acrylate, especially preferably acrylic acid and/or acrylate, and maleic acid and/or maleate and 5 wt % to 40 wt %, preferably 10 wt % to 30 wt %, of vinyl alcohol and/or vinyl acetate. Exceedingly preferred are terpolymers in which the weight ratio of (meth)acrylic acid and/or (meth)acrylate to maleic acid and/or maleate is between 1:1 and 4:1, preferably between 2:1 and 3:1, and particularly between 2:1 and 2.5:1. The amounts and the weight ratios are related to the acids. The second acidic monomer or salt thereof can also be a derivative of an allyl sulfonic acid that is substituted in the 2 position with an alkyl residue, preferably a $C_1$-$C_4$ alkyl residue, or an aromatic residue that is preferably derived from benzene or benzene derivatives. Preferred terpolymers contain 40 wt % to 60 wt %, particularly 45 to 55 wt %, of (meth)acrylic acid and/or (meth)acrylate, especially preferably acrylic acid and/or acrylate, 10 wt % to 30 wt %, preferably 15 wt % to 25 wt %, of methallyl sulfonic acid and/or methallyl sulfonate, and, as a third monomer, 15 wt % to 40 wt %, preferably 20 wt % to 40 wt %, of a carbohydrate. Said carbohydrate can be, for example, a mono-, di-, oligo-, or polysaccharide, wherein mono-, di-, or oligosaccharides are preferred and sucrose is especially preferred. It is presumed that, as a result of the use of the third monomer, predetermined breaking points are incorporated into the polymer, and said predetermined breaking points are responsible for the good biodegradability of the polymer. Said terpolymers generally have a relative molecular mass between 1000 g/mol and 200000 g/mol, preferably between 2000 g/mol and 50000 g/mol, and particularly between 3000 g/mol and 10000 g/mol. Particularly in order to produce liquid agents, said terpolymers can be used in the form of aqueous solutions, preferably in the form of 30- to 50-weight-percent aqueous solutions. All mentioned polycarboxylic acids are generally used in the form of water-soluble salts thereof, particularly alkali salts thereof.

Such organic builder substances are preferably contained in amounts of up to 40 wt %, particularly up to 25 wt %, and especially preferably 1 wt % to 5 wt %. Amounts near the mentioned upper limit are preferably used in pasty or liquid, particularly water-containing, agents.

Crystalline or amorphic alkali aluminosilicates, in particular, are used as water-insoluble, water-dispersible inorganic builder materials, in amounts of up to 50 wt %, preferably not above 40 wt %, and in liquid agents particularly from 1 wt % to 5 wt %. Among these, the crystalline aluminosilicates in washing-agent quality, particularly zeolite NaA and possibly NaX, are preferred. Amounts close to the mentioned upper limit are preferably used in solid, particulate agents. In particular, suitable aluminosilicates do not have any particles having a grain size above 30 μm and preferably consist of at least 80 wt % of particles having a size below 10 μm. The calcium-binding capacity thereof, which can be determined in accordance with the specifications of German patent document DE 2412837, lies in the range of 100 to 200 mg CaO per gram. Suitable substitutes or partial substitutes for the mentioned aluminosilicate are crystalline alkali silicates, which can be present alone or in mixture with amorphous silicates. The alkali silicates usable in the agents as builder materials preferably have a molar ratio of alkali oxide to $SiO_2$ of less than 0.95, particularly 1:1.1 to 1:12, and can be in amorphous or crystalline form. Preferred alkali silicates are the sodium silicates, particularly the amorphous sodium silicates, having a molar ratio $Na_2O$: $SiO_2$ of 1:2 to 1:2.8. Such amorphous alkali silicates are commercially available, for example under the name Portil®. In the production process, those having a molar ratio $Na_2O$: $SiO_2$ of 1:1.9 to 1:2.8 are preferably added as a solid and not in the form of a solution. As crystalline silicates, which can be present alone or in mixture with amorphous silicates, preferably crystalline phyllosilicates of the general formula $Na_2Si_xO_{2x+1}.yH_2O$, in which x, the so-called modulus, is a number from 1.9 to 4 and y is a number from 0 to 20 and preferred values for x are 2, 3, or 4, are used. Preferred crystalline phyllosilicates are those in the case of which x assumes the value 2 or 3 in the stated general formula. In particular, both β- and δ-sodium disilicates ($Na_2Si_2O_5.yH_2O$) are preferred. Practically water-free crystalline alkali silicates of the aforementioned general formula, in which x means a number from 1.9 to 2.1, that are produced from amorphous alkali silicates can also be used in agents that contain an active substance to be used according to the invention. In another preferred embodiment of agents according to the invention, a crystalline sodium phyllosilicate having a modulus of 2 to 3 is used, which can be produced from sand and soda. Crystalline sodium silicates having a modulus in the range of 1.9 to 3.5 are used in another preferred embodiment of washing agents that contain an active substance used according to the invention. The content of alkali silicates therein is preferably 1 wt % to 50 wt % and particularly 5 wt % to 35 wt %, with respect to water-free active material. If alkali aluminosilicate, particularly zeolite, is also present as an additional builder substance, the content of alkali silicate is preferably 1 wt % to 15 wt % and particularly 2 wt % to 8 wt %, with respect to water-free active material. The weight ratio of aluminosilicate to silicate, with respect to water-free active materials, is then preferably 4:1 to 10:1. In agents that contain both amorphous alkali silicates and crystalline alkali silicates, the weight ratio of amorphous alkali silicate to crystalline alkali silicate is preferably 1:2 to 2:1 and particularly 1:1 to 2:1.

In addition to the mentioned inorganic builders, other water-soluble or water-insoluble inorganic substances can be contained in the agents that contain an active substance to be used according to the invention, are used together with said active substance, or are used in methods according to the invention. In this context, the alkali carbonates, alkali hydrogencarbonates, and alkali sulfates and mixtures thereof are suitable. Such additional inorganic material can be present in amounts of up to 70 wt %.

In addition, the agents can contain further constituents typical in washing or cleaning agents. These optional constituents include, in particular, enzymes, enzyme stabilizers, complexing agents for heavy metals, such as aminopolycarboxylic acids, aminohydroxypolycarboxylic acids, polyphosphonic acids, and/or aminopolyphosphonic acids, antifoaming agents, such as organopolysiloxanes or paraffins, solvents, and optical brighteners, such as stilbenedisulfonic acid derivatives. Up to 1 wt %, particularly 0.01 wt % to 0.5 wt %, of optical brighteners, particularly compounds from the class of the substituted 4,4'-bis-(2,4,6,-triamino-s-triazinyl)-stilbene-2,2'-disulfonic acids, up to 5 wt %, particularly 0.1 wt % to 2 wt %, of complexing agents for heavy metals, particularly amino alkylene phosphonic acids and salts thereof, and up to 2 wt %, particularly 0.1 wt % to 1 wt %, of antifoaming agents are preferably contained in agents that contain an active substance used according to the invention, wherein the stated weight percentages relate to the entire agent.

Solvents that can be used particularly in the case of liquid agents are, in addition to water, preferably non-aqueous solvents that are miscible with water. These include the lower alcohols, such as ethanol, propanol, isopropanol, and the isomeric butanols, glycerol, lower glycols, such as ethylene glycol and propylene glycol, and the ethers that can be derived from the mentioned classes of compounds. In such liquid agents, the active substances used according to the invention are generally in dissolved or suspended form. Optionally present enzymes are selected preferably from the group comprising protease, amylase, lipase, cellulase, hemicellulase, oxidase, peroxidase, pectinase, and mixtures thereof. Primarily, protease obtained from microorganisms, such as bacteria or fungi, is possible. Said protease can be obtained from suitable microorganisms by fermentation processes in a known manner. Proteases are commercially available under the names BLAP®, Savinase®, Esperase®, Maxatase®, Optimase®, Alcalase®, Durazym®, and Maxapem®, for example. The usable lipase can be obtained from *Humicola lanuginosa, Bacillus* species, *Pseudomonas* species, *Fusarium* species, *Rhizopus* species, or *Aspergillus* species, for example. Suitable lipases are commercially available under the names Lipolase®, Lipozym®, Lipomax®, Lipex®, Amano® lipase, Toyo-Jozo® lipase, Meito® lipase, and Diosynth® lipase, for example. Suitable amylases are commercially available under the names Maxamyl®, Termamyl®, Duramyl®, and Purafect® OxAm, for example. The usable cellulase can be an enzyme that can be obtained from bacteria or fungi and that has a pH optimum preferably in the weakly acid to weakly basic range of 6 to 9.5. Such cellulases are commercially available under the names Celluzyme®, Carezyme®, and Ecostone®. Suitable pectinases are available under the names Gamanase®, Pektinex AR®, X-Pect®, and Pectaway® from Novozymes, under the names Rohapect UF®, Rohapect TPL®, Rohapect PTE100®, Rohapect MPE®, Rohapect MA plus HC, Rohapect DA12L®, Rohapect 10L®, and Rohapect B1L® from AB Enzymes, and under the name Pyrolase® from Diversa Corp., San Diego, Calif., USA, for example.

The typical enzyme stabilizers optionally present, particularly in liquid agents, include amino alcohols, such as mono-, di-, triethanol and -propanol amine and mixtures thereof, lower carboxylic acids, boric acid, alkali borates, boric acid/carboxylic acid combinations, boric acid esters, boronic acid derivatives, calcium salts, such as Ca/formic acid combination, magnesium salts, and/or reductants containing sulfur.

The suitable antifoaming agents include long-chain soaps, particularly behenic soap, fatty acid amides, paraffins, waxes, microcrystalline waxes, organopolysiloxanes, and mixtures thereof, which can also contain microtine, optionally silanized or otherwise hydrophobed silicic acid. For use in particulate agents, such antifoaming agents are preferably bonded to granular, water-soluble carrier substances.

The known polyester-active polymers that allow the removal of dirt include copolyesters of dicarboxylic acids, such as adipic acid, phthalic acid, or terephthalic acid, of diols, such as ethylene glycol or propylene glycol, and of polydiols, such as polyethylene glycol or polypropylene glycol. The preferably used polyesters that allow the removal of dirt include compounds that are formally obtainable by esterifying two monomer parts, wherein the first monomer is a dicarboxylic acid HOOC—Ph-COOH and the second monomer is a diol HO—$(CHR^{11})_a$OH, which can also be in the form of a polymeric diol H—(O—$(CHR_{11}—)_a)_b$OH. Therein, Ph means an o-, m-, or p-phenylene residue, which can bear 1 to 4 substituents, selected from alkyl residues having 1 to 22 C atoms, sulfonic acid groups, carboxyl groups, and mixtures thereof, $R^{11}$ means hydrogen, an alkyl residue having 1 to 22 C atoms, and mixtures thereof, a means a number from 2 to 6, and b means a number from 1 to 300. In the polyesters obtainable therefrom, there are preferably both monomer diol units —O—$(CHR_{11}—)_a$O— and polymer diol units —(O—$(CHR^{11}—)_a)_b$O—. The molar ratio of monomer diol units to polymer diol units is preferably 100:1 to 1:100, particularly 10:1 to 1:10. In the polymer diol units, the degree of polymerization b preferably lies in the range of 4 to 200, particularly 12 to 140. The molecular weight or the average molecular weight or the maximum of the molecular weight distribution of preferred polyesters that allow the removal of dirt lies in the range of 250 g/mol to 100000 g/mol, particularly 500 g/mol to 50000 g/mol. The acid on which the residue Ph is based is selected preferably from terephthalic acid, isophthalic acid, phthalic acid, trimellitic acid, mellitic acid, the isomers of sulfophthalic acid, sulfoisophthalic acid, and sulfoterephthalic acid and mixtures thereof. If the acid groups thereof are not part of the ester bonds in the polymer, they are preferably in salt form, particularly as an alkali or ammonium salt. Among these, the sodium and potassium salts are especially preferred. Instead of the monomer HOOC—Ph-COOH, small percentages, particularly not more than 10 mol % with respect to the percentage of Ph having the meaning given above, of other acids that have at least two carboxyl groups can optionally be contained in the polyester that allows the removal of dirt. Said other acids include, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. The preferred diols HO—$(CHR^{11}—)_a$OH include those in which $R^{11}$ is hydrogen and a is a number from 2 to 6 and those in which a has the value of 2 and $R^{11}$ is selected from among hydrogen and the alkyl residues having 1 to 10, particularly 1 to 3, C atoms. Among the latter diols, those of the formula HO—$CH_2$—$CHR^{11}$—OH, in which $R^{11}$ has the aforementioned meaning, are especially preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Especially preferred among the polymeric diols is polyethylene glycol having an average molar mass in the range of 1000 g/mol to 6000 g/mol. Optionally, the polyesters can also be end-capped, wherein alkyl groups having 1 to 22 C atoms and esters of monocarboxylic acids are possible as end groups. The end groups bonded by means of ester bonds can be based on alkyl, alkenyl, and aryl monocarboxylic acids having 5 to 32 C atoms, particularly 5 to 18 C atoms. Said monocarboxylic acids include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselinic acid, petroselaidic acid, oleic acid, linoleic acid, linolelaidic acid, linolenic acid, elaeostearic acid, arachidic acid, gadoleic acid, arachidonic acid, behenic acid, erucic acid, brassidic acid, clupanodonic acid, lignoceric acid, cerotic acid, melissic acid, and benzoic acid, which monocarboxylic acids can bear 1 to 5 substituents having up to 25 C atoms, particularly 1 to 12 C atoms, in total, such as tert-butylbenzoic acid. The end groups can also be based on hydroxymonocarboxylic acids having 5 to 22 C atoms, which include, for example, hydroxyvaleric acid, hydroxycaproic acid, ricinoleic acid, the hydrogenation product thereof hydroxystearic acid, and o-, m-, and p-hydroxybenzoic acid. For their part, the hydroxymonocarboxylic acids can be linked to each other by means of the hydroxyl group thereof and the carboxyl group thereof, so that multiple hydroxymonocarboxylic acids are present in one end group. The number of hydroxymonocarboxylic acid units per end group, i.e., the degree of oligomerization of the end group, preferably lies in the range of 1 to 50, particularly 1 to 10. In a preferred embodiment of the invention, polymers of ethylene terephthalate and polyethylene oxide terephthalate in which the polyethylene glycol units have molar weights of 750 g/mol to 5000 g/mol and the molar ratio of ethylene terephthalate to polyethylene oxide terephthalate is 50:50 to 90:10 are used in combination with an active substance essential to the invention. The polymers that allow the removal of dirt are preferably water-soluble, wherein the term "water-soluble" should be understood to mean a solubility of at least 0.01 g, preferably at least 0.1 g, of the polymer per liter of water at room temperature and pH 8. However, preferably used polymers have a solubility of at least 1 g per liter, particularly at least 10 g per liter, under these conditions.

In one embodiment of the invention, in particular the laundry care agents used as aftertreatment agents and having the amino-group-containing polymer having carboxylic-acid-group-bearing substituents can contain additional softener components, preferably cationic surfactants. Examples of fabric-softening components are quaternary

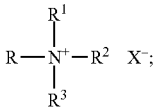

(II)

-continued

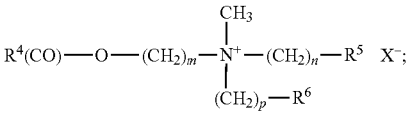

(III)

ammonium compounds, cationic polymers, and emulsifiers, which are used in hair care agents and also in agents for textile softening.

Suitable examples are quaternary ammonium compounds of formulas (II) and (III), wherein in (II) R and $R^1$ represent an acyclic alkyl residue having 12 to 24 carbon atoms, $R^2$ represents a saturated $C_1$-$C_4$ alkyl or hydroxyalkyl residue, $R^3$ either is identical to R, $R^1$, or $R^2$ or represents an aromatic residue. $X^-$ represents a halide, methosulfate, methophosphate, or phosphate ion or mixtures thereof. Examples of cationic compounds of formula (II) are didecyl dimethyl ammonium chloride, ditallow dimethyl ammonium chloride, and dihexadecyl ammonium chloride.

Compounds of formula (III) are so-called esterquats. Esterquats are characterized by the good biodegradability thereof and are preferred in the context of the present invention. Here, $R^4$ represents an aliphatic alkyl residue having 12 to 22 carbon atoms and having 0, 1, 2, or 3 double bonds; $R^5$ represents H, OH, or $O(CO)R^7$, $R^6$ represents H, OH, or $O(CO)R^8$ independently of $R^5$, wherein $R^7$ and $R^8$ represent an aliphatic alkyl residue having 12 to 22 carbon atoms and having 0, 1, 2, or 3 double bonds independently of each other. m, n, and p can have the value 1, 2, or 3 independently of each other. $X^-$ can be a halide, methosulfate, methophosphate, or phosphate ion or mixtures thereof. Compounds that contain the group $O(CO)R^7$ for $R^5$ and alkyl residues having 16 to 18 carbon atoms for $R^4$ and $R^7$ are preferred. Compounds in the case of which $R^6$ additionally represents OH are especially preferred. Examples of compounds of formula (III) are methyl-N-(2-hydroxyethyl)-N,N-di(tallow acyl-oxyethyl)ammonium methosulfate, bis-(palmitoyl)-ethyl hydroxyethyl methylammonium methosulfate, or methyl-N,N-bis(acyloxyethyl)-N-(2-hydroxyethyl)ammonium methosulfate.

In a preferred embodiment, the agents contain the additional softener components in amounts of up to 35 wt %, preferably 0.1 to 25 wt %, especially preferably 0.5 to 15 wt %, and particularly 1 to 10 wt %, with respect to the entire agent.

In addition to the components mentioned above, the agents can contain pearlizing agents. Pearlizing agents give the textiles an additional sheen and therefore are preferably used in fine washing agents. For example, the following are possible as pearlizing agents: alkylene glycol esters; fatty acid alkanolamides; partial glycerides, esters of polyvalent, possibly hydroxy-substituted carboxylic acids with fatty alcohols having 6 to 22 carbon atoms; fatty substances, such as fatty alcohols, fatty ketones, fatty aldehydes, fatty ethers, and fatty carbonates, which have at least 24 carbon atoms in total; ring-opening products of olefin epoxides having 12 to 22 carbon atoms with fatty alcohols having 12 to 22 carbon atoms, fatty acids, and/or polyols having 2 to 15 carbon atoms and 2 to 10 hydroxyl groups and mixtures thereof.

Furthermore, liquid agents can additionally contain thickeners. The use of thickening agents has proven itself for increasing consumer acceptance, particularly in the case of liquid washing agents in gel form. Polymers originating from nature that can be used as thickening agents are, for example, agar-agar, carrageenan, tragacanth, gum arabic, alginates, pectins, polyoses, guar gum powder, locust bean gum, starch, dextrins, gelatins, and casein, cellulose derivatives such as carboxymethyl cellulose and hydroxyethyl and hydroxypropyl cellulose, and polymeric polysaccharide thickening agents such as xanthan gum; in addition, fully synthetic polymers such as polyacrylic and polymethacrylic compounds, vinyl polymers, polycarboxylic acids, polyethers, polyimines, polyamides, and polyurethanes are also possible. In a preferred embodiment, the textile care agents according to the invention contain thickeners, preferably in amounts of up to 10 wt %, especially preferably up to 5 wt %, particularly 0.1 to 1 wt %, with respect to the entire agent.

Furthermore, the agents can additionally contain odor absorbers and/or dye transfer inhibitors. In a preferred embodiment, the agents contain possibly 0.1 wt % to 2 wt %, preferably 0.2 wt % to 1 wt %, of dye transfer inhibitor, which in a preferred embodiment of the invention is a polymer of vinylpyrrolidone, vinylimidazole, or vinylpyridine N-oxide or a copolymer thereof. Polyvinylpyrrolidones having molecular weights of 15 000 to 50 000, for example, as well as polyvinylpyrrolidones having molecular weights of over 1 000 000, particularly 1 500 000 to 4 000 000, N-vinylimidazole/N-vinylpyrrolidone copolymers, polyvinyl oxazolidones, copolymers based on vinyl monomers and carboxylic acid amides, pyrrolidione-group-containing polyesters and polyamides, graft polyamidoamines, polyamine N-oxide polymers, polyvinyl alcohols, and copolymers based on acrylamide alkenyl sulfonic acids are usable. However, enzymatic systems, comprising a peroxidase and hydrogen peroxide or a substance that provides hydrogen peroxide in water, can also be used. The addition of a mediator compound for the peroxidase, for example an acetosyringone, a phenol derivative, or a phenothiazine or phenoxazine, is preferred in this case, wherein polymeric dye-transfer-inhibitor active substances mentioned above can additionally be used. Polyvinylpyrrolidone preferably has an average molar mass in the range of 10 000 to 60 000, particularly in the range of 25 000 to 50 000, for use in agents according to the invention. Among the copolymers, those of vinylpyrrolidone and vinylimidazole in a molar ratio of 5:1 to 1:1 having an average molar mass in the range of 5 000 to 50 000, particularly 10 000 to 20 000, are preferred.

Preferred deodorizing substances are metal salts of an unbranched or branched, unsaturated or saturated, mono- or polyhydroxylated fatty acid having at least 16 carbon atoms and/or of a resin acid, with the exception of the alkali metal salts, and any mixtures thereof. An especially preferred unbranched or branched, unsaturated or saturated, mono- or polyhydroxylated fatty acid having at least 16 carbon atoms is ricinoleic acid. An especially preferred resin acid is abietic acid. Preferred metals are the transition metals and the lanthanoids, particularly the transition metals of groups VIIIa, Ib, and IIb of the periodic table and lanthanum, cerium, and neodymium, especially preferably cobalt, nickel, copper, and zinc, extremely preferably zinc. Although the cobalt, nickel, and copper salts and the zinc salts have very similar effect, the zinc salts are preferable for toxicological reasons. One or more metal salts of ricinoleic acid and/or of abietic acid, preferably zinc ricinoleate and/or zinc abietate, particularly zinc ricinoleate, are advantageously and therefore especially preferably usable as deodorizing substances. Cyclodextrins and mixtures of the metal salts mentioned above with cyclodextrin likewise prove to be other suitable deodorizing substances in the sense of the invention, preferably in a weight ratio of 1:10 to 10:1, especially preferably 1:5 to 5:1, and particularly 1:3 to 3:1. The term "cyclodextrin" comprises all known cyclodextrins, i.e., unsubstituted cyclodextrins having 6 to 12 glucose units, particularly alpha-, beta-, and gamma-cyclodextrins, as well as mixtures thereof and/or derivatives thereof and/or mixtures thereof.

The production of solid agents used according to the invention poses no difficulties and can occur in a known manner, for example by spray drying or granulation, wherein, for example, enzymes and possible other thermally sensitive ingredients such as bleaching agents can optionally be added separately later. To produce agents according to the invention having increased apparent density, particularly in the range of 650 g/l to 950 g/l, a method having an extrusion step is preferred.

To produce agents in tablet form, which can be single-phase or multi-phase and single-color or multi-color and in particular can consist of one layer or several layers, particularly two layers, one preferably proceeds in such a way that all constituents—of each layer separately, if applicable—are mixed with each other in a mixer and the mixture is pressed by means of traditional tablet presses, such as eccentric presses or rotary presses, with pressing forces in the range of approximately 50 to 100 kN, preferably at 60 to 70 kN. Particularly in the case of multi-layer tablets, it can be advantageous if at least one layer is pre-pressed. This is preferably performed at pressing forces between 5 and 20 kN, particularly at 10 to 15 kN. In this way, tablets that are fracture-resistant yet sufficiently quickly soluble under conditions of use and that have fracture and bending strength of normally 100 to 200 N, but preferably above 150 N, are obtained without problems. A tablet produced in such a way preferably has a weight of 10 g to 50 g, particularly 15 g to 40 g. The spatial shape of the tablets is not fixed and can be round, oval, or angular, wherein intermediate shapes are also possible. Corners and edges are advantageously rounded off. Round tablets preferably have a diameter of 30 mm to 40 mm. In particular, the size of angular or rectangular-cuboid-shaped tablets, which are introduced mainly via the dosing device of, for example, the washing machine, depends on the geometry and the volume of said dosing device. Embodiments preferred as an example have a base area of (20 to 30 mm)×(34 to 40 mm), particularly 26×36 mm or 24×38 mm.

Liquid or pasty agents in the form of solutions containing typical solvents, particularly water, are generally produced by simple mixing of the ingredients, which can be introduced into an automatic mixer as substance or as a solution.

In an especially preferred embodiment, the agents, which are preferably in liquid form, are in the form of a portion in a completely or partially water-soluble wrapping. The portioning makes the dosing easier for the consumer.

The agents can be packaged in film bags, for example. Bag packaging composed of water-soluble film makes it unnecessary for the consumer to tear open the package. In this way, an individual portion sized for one washing cycle can be conveniently dosed by inserting the bag directly into the washing machine or by throwing the bag into a certain amount of water, for example in a bucket, a bowl, or in a hand-washing sink. The film bag surrounding the washing portion dissolves without residue when a certain temperature is reached.

Numerous methods for producing water-soluble washing-agent portions exist in the prior art, and said methods generally can also be used in the context of the present invention. The most well-known methods are the tubular-film methods with horizontal and vertical sealing seams. The thermoforming method (deep-drawing method) is also suitable for producing film bags or dimensionally stable washing-agent portions. However, the water-soluble wrappings do not necessarily have to be made of a film material, but rather can also be dimensionally stable containers, which, for example, can be obtained by means of an injection-molding method.

Furthermore, methods for producing water-soluble capsules from polyvinyl alcohol or gelatin are known, which, in principle, offer the possibility of providing capsules having a high degree of filling. The basis of the methods is that the water-soluble polymer is introduced into a molding cavity. The capsules are filled and sealed either synchronously or in successive steps, wherein in the latter case the capsules are filled through a small opening. The capsules are filled, for example, by means of a filling wedge, which is arranged above two drums, which rotate against each other and which have spherical half-shells on the surface thereof. The drums guide polymer strips, which cover the spherical half-shell cavities. Sealing occurs at the positions at which the polymer strip of the one drum meets the polymer strip of the opposite drum. At the same time, the filling material is injected into the capsule being formed, wherein the injection pressure of the filling liquid presses the polymer strips into the spherical half-shell cavities. A method for producing water-soluble capsules in which first the filling occurs and then the sealing occurs is based on the so-called Bottle-Pack® method. In said method, a tubular preform is guided into a two-part cavity. The cavity is closed, wherein the lower tube segment is sealed, and then the tube is inflated in order to form the capsule shape in the cavity, filled, and finally sealed.

The wrapping material used to produce the water-soluble portion is preferably a water-soluble polymeric thermoplastic, especially preferably selected from the group of (optionally partially acetalated) polyvinyl alcohol, polyvinyl alcohol copolymers, polyvinylpyrrolidone, polyethylene oxide, gelatin, cellulose and derivatives thereof, starch and derivatives thereof, blends and composites, inorganic salts, and mixtures of the mentioned materials, preferably hydroxypropyl methylcellulose and/or polyvinyl alcohol blends. Polyvinyl alcohols are commercially available, for example under the trademark Mowiol® (Clariant). Polyvinyl alcohols that are especially suitable in the context of the present invention are, for example, Mowiol® 3-83, Mowiol® 4-88, Mowiol® 5-88, Mowiol® 8-88, and Clariant L648. Additionally, the water-soluble thermoplastic used to produce the portion can optionally have polymers selected from the group comprising acrylic-acid-containing polymers, polyacrylamides, oxazoline polymers, polystyrene sulfonates, polyurethanes, polyesters, polyethers, and/or mixtures of the aforementioned polymers. It is preferred if the water-soluble thermoplastic used comprises a polyvinyl alcohol whose degree of hydrolysis amounts to 70 to 100 mol %, preferably 80 to 90 mol %, especially preferably 81 to 89 mol %, and particularly 82 to 88 mol %. Also preferred is that the water-soluble thermoplastic used comprises a polyvinyl alcohol whose molecular weight lies in the range of 10,000 to 100,000 $gmol^{-1}$, preferably 11,000 to 90,000 $gmol^{-1}$, especially preferably 12,000 to 80,000 $gmol^{-1}$, and particularly 13,000 to 70,000 $gmol^{-1}$. It is also preferred if the thermoplastics are present in amounts of at least 50 wt %, preferably at least 70 wt %, especially preferably at least 80 wt %, and particularly at least 90 wt %, with respect to the weight of the water-soluble polymeric thermoplastic.

EXAMPLES

Example 1: Production of Amino-Group-Containing Polymers Having Carboxylic-Acid-Group-Bearing Substituents 0.5 g of bromoacetic acid were added to 2 g of a 6-weight-percent solution of aminopropylmethylsiloxane-dimethylsiloxane copolymer (manufacturer Gelest Inc.) and 4 g of NaOH in 100 ml of water, and the reaction system was held at room temperature for 24 hours. Then the pH value was brought to pH 5 to 6 by adding hydrochloric acid. After a few drops of the nonionic emulsifier Marlipal® O 13/60 were added, a homogeneous emulsion was obtained.

Example 2: Wrinkle Reduction Test

Test textiles of a size of approximately 12×18 cm were cut out from woven cotton fabric from which the finish had been removed (type "Stella Royal" from the manufacturer Brenneth) and were ironed. The aqueous emulsion of example 1, thinned to a content of 1 wt % of the polymer, was applied to the cloths in such a way that a degree of moisture penetration of approximately 100% of the textile weight resulted. The cloths were dried for 45 minutes at 25° C. and then ironed smooth (temperature, two points) with an iron common in the home (Rowenta®, model DE634B).

The crease recovery angle was measured on the cloths (E1) treated in such a way.

For comparison, cloths of the untreated textile (V1) were also measured.

After a crease recovery time of 5 minutes or 30 minutes, the values for the crease recovery angle stated in table 1 (average values from five determinations) resulted.

TABLE 1

| Crease recovery angles | | |
|---|---|---|
| Recovery time | E1 | V1 |
| 5 minutes | 86.8° | 67.4° |
| 30 minutes | 95.8° | 75.4° |

The aminopropylmethylsiloxane-dimethylsiloxane copolymer without carboxylic acid groups (V2) used in example 1 as a starting material was applied from 2-weight-percent formulation but otherwise tested in the same way and was compared with amino-group-containing polymer having carboxylic-acid-group-bearing substituents E1 likewise applied from 2-weight-percent formulation. The crease recovery angles stated in table 2 were observed (average values from five determinations).

TABLE 2

| Crease recovery angles | | |
|---|---|---|
| Recovery time | E1 | V2 |
| 30 minutes | 92° | 77° |

It is clear that the aminosiloxane having the carboxyl-group-bearing substituents causes a considerable improvement in the crease recovery angle.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for treating textiles made of cellulose-containing material comprising: bringing the textiles into contact with an amino-group-containing polymer having carboxylic-acid-group-bearing substituents wherein the polymer is selected from aminopolysiloxanes having formula (I), $$R^1{}_2R^2Si—O—(SiR^1R^2—O—)_nSiR^1{}_2R^2,$$

in which $R^1$ represents straight-chain or branched or cyclic $C_1$ to $C_{18}$ hydrocarbon residues, $R^2$ represents $R^1$ or one of the groups $—R^3—NHR^4$ or $R^3—NR^4—R^3—NHR^4$, in which $R^3$ represents a straight-chain or branched or cyclic divalent $C_1$ to $C_{18}$ hydrocarbon residue and $R^4$ represents a hydrogen atom, a $C_1$ to $C_{10}$ alkyl residue, and n represents a value from 10 to 2000, wherein not all residues $R^1$, not all residues $R^2$, not all residues $R^3$, and not all residues $R^4$ must be identical in the compound, with the stipulation that at least 2 of the residues $R^2$ are not $R^1$ and, in at least 1 of the residues $R^2$ that are not $R^1$ and the residue $R^4$ is a group $—R^5—COOX$, in which $R^5$ is a divalent hydrocarbon residue having 1 to 30 carbon atoms, and X is hydrogen, an alkali metal, or an ammonium group.

2. The method according to claim 1, wherein the textiles made of cellulose-containing material are brought into contact with the amino-group-containing polymer having carboxylic-acid-group-bearing substituents at temperatures in the range of 10° C. to 100° C. over a time span of 10 minutes to 180 minutes.

3. The method according to claim 2, wherein the textiles are brought into contact with the polymer at temperatures in the range of 20° C. to 60° C. over a time span of 30 minutes to 60 minutes.

4. The method according to claim 1, wherein the textiles are ironed with a common household iron after the treatment with the amino-group-containing polymer having carboxylic-acid-group-bearing substituents.

5. The method according to claim 4, wherein ironing temperatures are in the range of 50° C. to 220° C.

6. The method according to claim 5, wherein the ironing temperatures are in the range of 100° C. to 160° C.

7. The method according to claim 1, wherein $R^5$ is a divalent hydrocarbon residue having 2 to 20 carbon atoms.

8. The method according to claim 1, wherein the amino-group in the amino-group-containing polymer is selected from polyvinylamines, polyalkylene imines, and mixtures thereof; and wherein the polyvinylamines and the polyalkylene imines bear substituents having carboxyl groups on the nitrogen atom of the amino function of the polyvinylamines and the polyalkylene imines.

* * * * *